United States Patent [19]

Koga et al.

[11] 4,444,093

[45] Apr. 24, 1984

[54] SLANT PLATE TYPE HYDRAULIC DEVICE

[75] Inventors: Kiyoshi Koga, Ooi; Kenichi Ikejiri, Kawagoe; Eiichiro Kawahara, Tokorozawa, all of Japan

[73] Assignee: Honda Giken Kogyo Kabushiki Kaisha, Tokyo, Japan

[21] Appl. No.: 313,983

[22] Filed: Oct. 22, 1981

[30] Foreign Application Priority Data

Oct. 22, 1980 [JP] Japan ..... 55-147690

[51] Int. Cl.[3] ..... F01B 13/04

[52] U.S. Cl. ..... 91/488; 91/507

[58] Field of Search ..... 74/60; 91/507, 499, 91/506

[56] References Cited

U.S. PATENT DOCUMENTS

| | | | |
|---|---|---|---|
| 2,608,159 | 8/1952 | Born | 91/488 |
| 3,246,577 | 4/1966 | MacIntosh | 74/60 |
| 3,292,554 | 12/1966 | Hessler | 417/269 |
| 3,641,829 | 2/1972 | Reynolds | 91/507 |
| 4,024,799 | 5/1977 | Forster | 91/499 |

FOREIGN PATENT DOCUMENTS

| | | | |
|---|---|---|---|
| 1226418 | 10/1966 | Fed. Rep. of Germany | 91/499 |
| 2341106 | 5/1974 | Fed. Rep. of Germany | 91/499 |
| 2804912 | 8/1978 | Fed. Rep. of Germany | 91/499 |
| 55-48012 | 12/1980 | Japan | 91/499 |
| 1598311 | 9/1981 | United Kingdom | 91/499 |

*Primary Examiner*—William L. Freeh

*Attorney, Agent, or Firm*—Armstrong, Nikaido, Marmelstein & Kubovcik

[57] ABSTRACT

A slant plate type hydraulic device is provided which comprises a frame, a cylinder rotatable mounted in the frame and a plurality of plunger means which are slidably fitted into the cylinder. The plunger means are positioned in a circular pattern around the axis of the cylinder. A holder means is provided, along with a slant plate means wherein the holder means holds the slant plate means such that the slant plate means and cylinder are rotatable with respect to one another. Also included is a plurality of shoe means, with each shoe means being universally, rotatably mounted on one of the plunger means, wherein the shoe means are in sliding contact with the slant plate means. Finally, biasing means are provided for holding the shoe means in contact with the plate means.

8 Claims, 2 Drawing Figures

SLANT PLATE TYPE HYDRAULIC DEVICE

BACKGROUND OF THE INVENTION

1. Field of the Invention

This invention relates to a hydraulic device such as the slant plate type hydraulic motor and hydraulic pump and, more particularly, to a hydraulic device which comprises: a cylinder rotatably supported in a frame; a plurality of plungers slidably fitted into the cylinder and arranged in a circle around the rotating axis of the cylinder; a slant plate held in the holder so as to be rotatable with respect to the cylinder; and a plurality of shoes which are mounted universally rotatably to the outer end of the plungers and which are placed in sliding contact with the inclined surface of the slant plate. The plungers are reciprocated in a sliding manner on the slant plate by the rotation of the cylinder or the cylinder is rotated by reciprocating the plungers slidably on the slant plate.

2. Description of the Prior Art

In hydraulic devices of the above type, shoes are placed in sliding contact with the inclined surface of the slant plate to make smooth the movement of the plungers along the slant plate. However, when the thrust of the plunger is suddenly reduced due to an oil pressure variation in the cylinder, the shoes may sometimes float from the inclined surface of the slant plate or vibrate. These phenomena in turn cause wear on the vibrating surface of the shoes and slant plate, noise and reduction in efficiency. The conventional practice to prevent the above phenomena is to place a common seat plate on the back of the shoes and secure the press plate which opposes the back of the seat plate to the slant plate holder. It is, however, very difficult from the standpoint of machining accuracy to keep the shoes, the seat plate and the press plate in an adequate pressing relationship with each other. Therefore, it is not easy to prevent the shoes from floating from the slant plate.

SUMMARY OF THE INVENTION

To overcome the above drawback, it is the object of this invention to provide a slant plate type hydraulic device which has a press plate mounted axially slidable to the slant plate holder so that the press plate faces the back of the shoes and which has a spring to resiliently urge the press plate toward the seat plate, whereby the floating and vibration of the shoes can reliably be prevented without requiring the highly accurate dimension control.

DESCRIPTION OF PREFERRED EMBODIMENT

Figure 1:
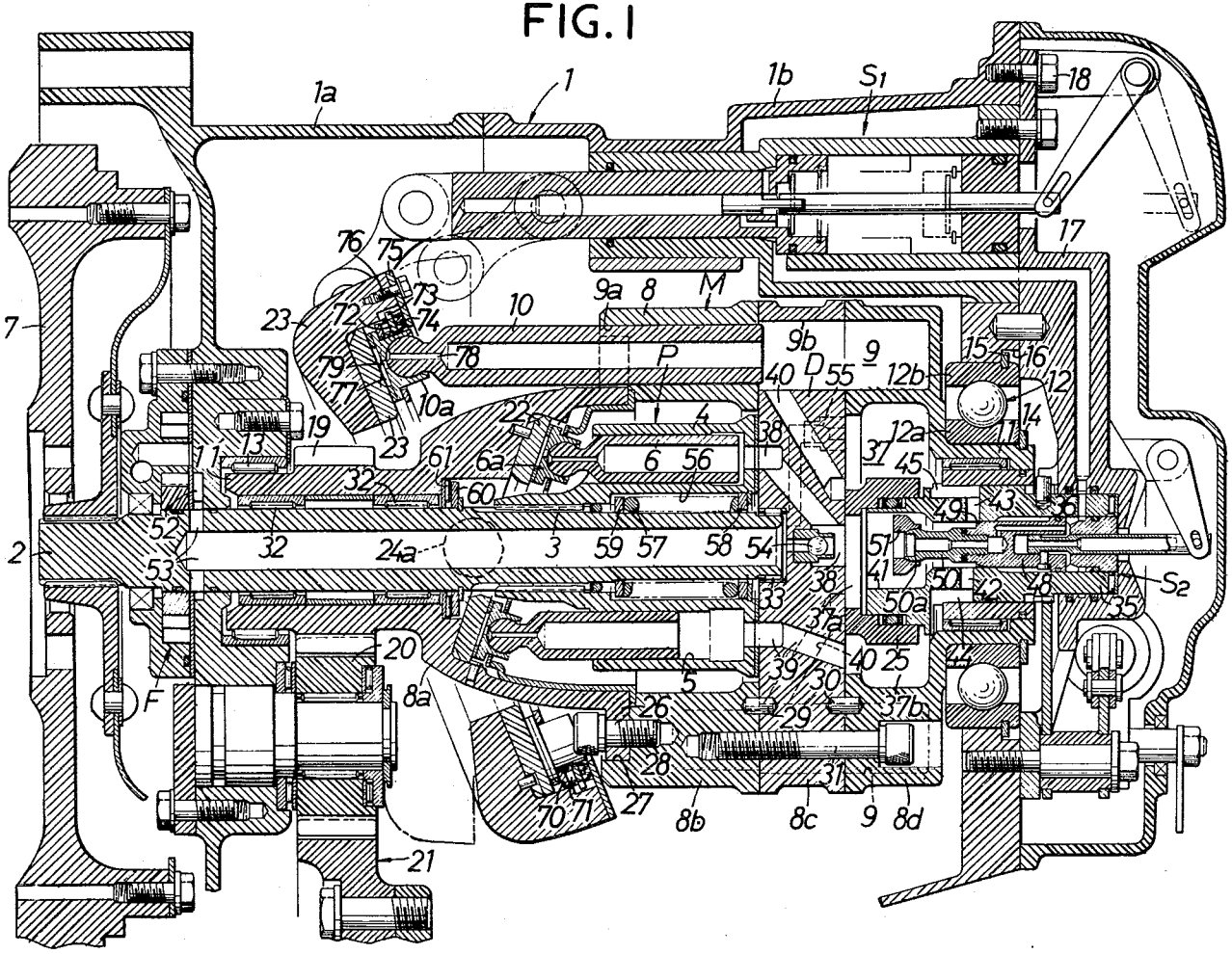
FIG. 1 is a longitudinal cross-section of a hydraulic automatic transmission in which this invention is applied to a hydraulic motor.

One embodiment of this invention will now be explained with reference to the accompanying drawings. In FIG. 1, a transmission case 1 consists of two halves 1*a*,1*b* combined together. The transmission contained in the case 1 consists of a hydraulic pump P and a hydraulic motor M.

The hydraulic pump P has a pump cylinder 4 splined at the central portion 3 to an input shaft 2. A number of cylinder holes 5 are provided in the cylinder 4 in circle around the center of the cylinder, and a number of pump plungers 6 are inserted into the cylinder holes 5. Power from an engine (not shown) is transmitted through a flywheel 7 to the input shaft 2. The hydraulic motor M has a motor cylinder 8 which coaxially receives the pump cylinder 4 therein and is rotatable relative thereto. A number of cylinder holes 9 are provided in the cylinder 8 circularly around the center thereof, and a number of motor plungers 10 are inserted into the cylinder holes 9, respectively.

The motor cylinder 8 has a pair of support shafts 11,11′ projected from the front and rear ends thereof. One of the support shafts 11 is supported on the rear end wall of the right half 1*b* of the case 1 through a ball bearing 12 and the other shaft 11′ is supported on the front end wall of the left half 1*a* of the case 1 through a needle bearing 13. The support shaft 11 has a stop ring 14 at the outer end to hold an inner race 12*a* of the ball bearing 12 by cooperating with the motor cylinder 8. Another stop ring 15 is installed in an annular recess 16 of the rear wall of the right half 1*b* of the case 1 such that the stop ring 15 engages with the outer circumference of an outer race 12*b* of the ball bearing 12. A retainer plate 17 in contact with the rear end of the outer race 12*b* is removably secured to the right half 1*b* of the case 1 by the bolt 18. In this way, the ball bearing 12 and the support shaft 11 are prevented from axially displacing relative to the right half 1*b* of the case 1.

The other support shaft 11′ has a gear 19 formed integral therewith to serve as an output shaft. The output of the hydraulic motor M is transmitted through the gear 19 and an intermediate gear 20 to a differential gear 21.

Securely provided inside the motor cylinder 8 is a pump slant plate 22 inclined at a certain angle with respect to pump plungers 6. A shoe 6*a* placed in sliding contact with the pump slant plate 22 is attached to the spherical head at the outer end of the plungers 6 so that it is universally movable about the spherical head. Thus, the pump slant plate 22, as the pump cylinder 4 rotates, causes the pump plungers 6 to reciprocate, thereby repeatedly making suction and discharge strokes.

The transmission case 1 has a slant plate holder 24 inclinably pivoted to a pair of trunnion shafts 24*a* projecting from each side of the case 1. Secured to the holder 24 is a motor slant plate 23 disposed opposite to motor plungers 10. Placed in sliding contact with the inclined surface of the motor slant plate 23 is a shoe 10*a* which is attached to the spherical head of each of the motor plungers 10 in such a manner that it is movable in any direction around the spherical head of the plungers 10. Thus, the motor slant plate 23, as the motor cylinder 8 rotates, causes the motor plungers 10 to reciprocate, thereby repeatedly making the expansion and contraction strokes. The stroke of the motor plungers 10 can be adjusted continuously by inclining the motor slant plate 23 in the range from a vertical upright position to the most inclined position, such as shown in the drawings.

Each of the shoes 10*a* has a flange 10*b* around its periphery and a single common seat plate 70 is placed on the back of the flange. A press plate 72, which is disposed on the back of the seat plate 70 with a thrust bearing 71 between them, is splined at 73 to the slant plate holder 24 so that it is axially slidable.

On the back of the press plate 72 is placed a spring 74 which urges the plate 72 toward the seat plate 70. The spring is pressed on the back by a retainer plate 75 to provide a predetermined preloading. The retainer plate 75 is secured to the slant plate holder 24 by the bolt 76. Although the spring 74 shown in FIG. 1 is a wave plate spring, it may be a coil spring or a disc spring.

Figure 2:
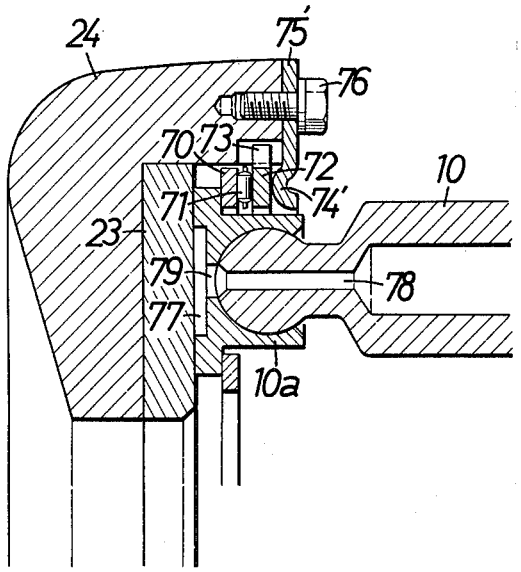
FIG. 2 is a cross-section of another embodiment of the present invention.

In the embodiment shown in FIG. 2, spring 74 and retaining plate 75 of the embodiment of FIG. 1 are replaced with a retaining plate 75' of a resilient spring material. The retaining plate 75' has a protruding portion 74' which contacts press plate 72 and biases press plate 72 against bearing 71. The retaining plate 75' is fixed to plate holder 24 by a bolt 76.

This invention is characterized by the above construction and, therefore, the hydraulic motor M represents the hydraulic device of this invention. The transmission case 1 corresponds to the machine frame of this invention, the motor cylinder 8 to the cylinder, the motor plunger 10 to the plunger and the motor slant plate 23 to the slant plate.

The shoes lOa are pressed by the spring 74 against the surface of the motor slant plate 23 so that they can slide on the motor slant plate 23 without floating from the slant plate surface as the motor cylinder 8 rotates. Since the seat plate 70 can smoothly rotate relative to the press plate 72 by the action of the thrust bearing 71, no twisting force is applied to the spring 74 during rotation of the seat plate 70. If the shoe 10*a* should wear due to its sliding movement, the reduction of shoe thickness is immediately and automatically compensated for by the spring 74 which urges the press plate 72 to advance as the shoe 10*a* wears. The shoe 10*a* and the motor slant plate 23 are thus kept in constant pressing contact with each other.

Each shoe 10*a* has a hydraulic pressure pocket 77 at its front portion which is connected to the oil chamber in the motor cylinder 8 through the oil holes 78,79 formed in the motor plunger 10 and the shoe 10*a*. When the motor cylinder 8 is in operation, the hydraulic pressure in the motor cylinder 8 is supplied to the hydraulic pressure pocket 77 and the pressure supplied to the pocket 77 acts upon the shoe 10*a* in such a way as to support the thrust force acting from the motor plunger 10 to the shoe 10*a*. This reduces the contact pressure between the shoe 10*a* and the motor slant plate 23 and, at the same time, lubricates the sliding surface between them.

The means for preventing floating of the shoe 10*a* and the means for hydraulically supporting the shoe 10*a* can also be applied to the hydraulic pump.

Between the hydraulic pump P and the hydraulic motor M is formed a closed hydraulic circuit via a distributor D and a distributor ring 25, both of which will be detailed later. As the pump cylinder 4 is rotated by the input shaft 2, the high pressure operating oil discharged from the cylinder hole 5 containing the pump plunger 6 on the discharge stroke is supplied to the cylinder hole 9 containing the motor plunger 10 on the expansion stroke, while the operating oil discharged from the cylinder hole 9 containing the motor plunger 10 on the contraction stroke is circulated into the cylinder hole 5 containing the pump plunger 6 on the suction stroke. At the same time, the motor cylinder 8 is rotated by the sum of the reaction torque which the pump plunger 6 on the discharge stroke applies to the motor cylinder 8 through the pump slant plate 22 and the reaction torque which the motor plunger 10 on the expansion stroke receives from the motor slant plate 23.

The transmission ratio of the motor cylinder 8 to the pump cylinder is given by:

$$\text{Transmission ratio} = \frac{\text{Number of revolution of pump cylinder 4}}{\text{Number of revolution of motor cylinder 8}}$$

$$= 1 + \frac{\text{Capacity of hydraulic motor } M}{\text{Capacity of hydraulic pump } P}$$

As can be seen from the above equation, by changing the capacity of the hydraulic motor M from zero to a certain value, it is possible to change the transmission ratio from 1 to a desired value. Since the capacity of the hydraulic motor M is determined by the stroke of the motor plunger 10, the transmission ratio can be continuously adjusted from 1 to a desired value by inclining the motor slant plate 23 from the upright position to a certain angle as described above. A hydraulic servo motor Sl is provided in the case 1 to incline the motor slant plate 23.

The motor cylinder 8 is axially divided into four parts: 8*a*, 8*b*, 8*c* and 8*d*. The first part 8*a* is provided with the support shaft 11' and the pump slant plate 22, the second part 8*b* with a guide hole 9*a* which is part of the cylinder hole 9 to guide the axial sliding movement of the motor plunger 10, and the third and fourth parts, 8*c* and 8*d*, with an oil hole 9*b* slightly greater in diameter than the guide hole 9*a*. The third part 8*c* constitutes the distributor D. The guide hole 9*a* and the oil hole 9*b* make up the cylinder hole 9.

The first part 8*a* of the motor cylinder 8 has at the rear end facing the second part 8*b*, a flange 26 formed integral therewith which is fitted into the positioning hole 27 formed at the front end of the second part 8*b* and is secured to the part 8*b* by a plurality of bolts 28. The second, third and fourth parts 8*b*, 8*c* and 8*d* have knock pins 29,30 at their respective joints to keep them in correct relative position and are secured together by a plurality of bolts 31.

The input shaft has its outer end supported in the central portion of the support shaft 11' through the needle bearing 32 and the inner end supported in the central portion of the distributor D through the needle bearing 33.

Formed between the input shaft 2 and the pump cylinder 4 and adjacent to the spline 3 is an annular spring chamber 56, in which a compression spring 57 is installed. The spring 57 is resiliently pressed at the right end against the seat plate 58 engaged with the pump cylinder 4 and, at the left end, is pressed against the seat plate 59 engaged with the input shaft 2. A stopper plate 60 is fixed to the input shaft 2 at a point slightly away from the left end of the pump cylinder 4 so that the stopper plate 60 faces the inner end of the motor cylinder 8. A needle thrust bearing 61 is interposed between the stopper plate 60 and the inner end of the motor cylinder 8. Thus, the resilient force of the spring 57 brings the pump cylinder 4 into pressing contact with the distributor D through the seat plate 58, thereby preventing leakage of oil from the gap at their sliding portions and, at the same time, the reactionary force of the spring 57 acts upon the seat plate 59, the input shaft 2, the stopper plate 60 and upon the motor cylinder 8.

A fixed shaft 35 passing through the support shaft 11 of the motor cylinder 8 is connected to the retainer plate 17 through the pin 36. A distribution ring 25 contacting the distributor D is eccentrically mounted on the inner end of the fixed shaft 35. The distribution ring 25 divides the hollow space 37 in the fourth part 8*d* of the motor cylinder 8 into the inner chamber 37*a* and the outer chamber 37*b*. The distributor D has a discharge port 38 and a suction port 39 provided therein. The discharge port 38 communicates the cylinder hole 5, whose pump plunger 6 is on the discharge stroke, with the inner chamber 37*a* and the suction port 39 communicates the cylinder hole 5, whose plunger 6 is on the suction stroke, with the outer chamber 37*b*. The distributor D also has a number of connection ports 40 through which the cylinder holes 9 of the motor cylinder 8 are connected to the inner chamber 37*a* of the outer chamber 37*b*.

Thus, as the pump cylinder 4 rotates, the high pressure operating oil generated by the pump plunger 6 on the discharge stroke is supplied from the discharge port 38 to the inner chamber 37*a* and further led to the connection port 40 communicating with the inner chamber 37*a* and then enters the cylinder hole 9, where the pressurized oil gives thrust to the plunger 10 which is undergoing the expansion stroke. At the same time, the operating oil discharged from the cylinder hole 9 by the motor plunger 10 on the contraction stroke is supplied through the connection port 40 communicating with the outer chamber 37*b* and through the suction port 39 into the cylinder hole 5, whose pump plunger 6 is on the suction stroke. In this way, the operating oil is circulated between the hydraulic pump P and the hydraulic motor M.

The fixed shaft 35 has a center hole 41 and a plurality of short-circuit ports (in the Figure, two ports are shown) 42,43 passing through the side wall of the shaft 35. These short-circuit ports 42,43 communicate at the inner ends thereof with the inner chamber 37*a* through the center hole 41. At the outer ends, the short-circuit ports 42,43 communicate with the outside grooves 44,45 of the fixed shaft 35, respectively. The short-circuit ports 42,43 are opened or closed by the rightward and leftward movement of the clutch valve 48 which slides through the center hole 41. That is, when the clutch valve 48 is in the right-hand side position, the short-circuit ports 42,43 are open to communicate the inner and outer chambers 34*a*, 37*b* with each other so that the operating oil discharged from the discharge port 38 of the distributor D is short-circuited to the suction port 39 and no pressure oil is supplied to the hydraulic motor M. The motor M then is not in operation, representing a clutch-off condition. When the clutch valve 48 is moved to the left to close the short-circuit ports 42,43, the operating oil circulates from the hydraulic pump P to the motor M and this represents the clutch-on condition. When the clutch valve 48 is in the intermediate position, the operating oil circulates according to the opening degree of the short-circuit ports 42,43 and this represents the half-clutch condition.

The clutch valve 48 has a valve rod 50 screwed into the front end thereof. The valve rod 50 has an umbrella-shaped valve body 51 mounted on the spherical head 50*a* thereof so that the valve body 51 is movable in any direction around the head. The valve body 51, when the clutch valve 48 moves past the clutch-on position toward the left, comes into contact with the distributor D to close the discharge port 38. The discharge port 38 is closed by the valve body 51 when the motor slant plate 23 is set upright to make the transmission ratio 1:1. The closure of the discharge port 38 hydraulically locks up the pump plunger 6 and, therefore, the motor cylinder 8 can be driven mechanically by the power transmitted from the pump cylinder 4 to the motor cylinder 8 through the pump plungers 6 and the pump slant plate 22. As a result, the thrust of the motor plunger 10 acting on the motor slant plate 23 is lost, reducing the resistance against rotation.

To slide the clutch valve 48, a hydraulic servo motor S2 is provided to the fixed shaft 35.

Mounted to the outside of the left half 1*a* of the case 1 is an oil pump F, which is driven by the input shaft 2 to draw the oil from an oil tank (not shown) and generate the operating oil of a predetermined pressure. The discharge port 52 of the pump F communicates through the oil passage 53 inside the input shaft 2 and the check valves 54,55 with the discharge port 38 of the distributor D and the outer chamber 37*b*, respectively. Hence if the operating oil should leak from the closed hydraulic circuit of the hydraulic motor M and the hydraulic pump P, the necessary amount of oil is automatically supplied from the pump F.

The structural features and advantages of this invention may be summarized as follows:

The shoes universally mounted on the plunger heads are placed in sliding contact with the inclined surface of the slant plate, with a common seat plate placed on the back of the shoes. The press plate provided on the back of the seat plate with the thrust bearing interposed therebetween is connected axially slidably to the slant plate holder. The spring is installed in the slant plate holder to urge the press plate against the seat plate.

With this construction, the shoes can be placed in pressing contact with the inclined surface of the slant plate simply by the resilient force of the spring without requiring highly precise dimensional control. Therefore, when the thrust of the plunger suddenly decreases, the shoes can be prevented from floating from the slant plate or vibrating so that the wear or damage to the shoes and the slant plate is very small. In addition, the noise due to the vibration of shoes and the deterioration of efficiency due to the floating of the shoes of the slant plate can be precluded. Moreover, if the shoes and the slant plate are worn, the wear can be immediately compensated for by the advancement of the press plate by the force of spring. Furthermore, since the spring is not subjected to the twisting force from the rotation of the seat plate, the spring maintains its condition for applying an adequate pressing force to the shoes. This also ensures long life of the spring.

The present invention may be embodied in other specific forms without departing from the spirit or essential characteristics thereof. The presently disclosed embodiments are, therefore, to be considered in all respects as being illustrative and not restrictive. The scope of this invention is intended to be indicated by the appended claims, rather than the foregoing description, and all changes which come within the meaning and range of equivalency of the claims are to be embraced therein.

What is claimed:

1. A slant plate type hydraulic device comprising:

(a) a frame;

(b) a cylinder rotatably mounted in said frame;

(c) a plurality of plunger means slidably fitted into said cylinder, said plunger means being positioned in a circular pattern about the axis of said cylinder;

(d) holder means;

(e) slant plate means wherein said holder means holds said slant plate means such that said slant plate means and cylinder are rotatable with respect to one another;

(f) a plurality of shoe means, each said shoe means being universally, rotatably mounted on one of said plunger means, wherein said shoe means are in sliding contact with said slant plate means; and (g) biasing means for holding said shoe means in contact with said plate means, said biasing means comprising a seat plate contacting said shoe means on a side thereof opposite to the side which contacts said slant plate means;

a press plate which is spline-connected to the holder means in an axially slideable manner;

bearing means between said seat plate and said press plate for permitting the relative movement therebetween; and spring means contacting said press plate for pushing said press plate, bearing means and seat plate toward said shoe means, thereby holding said shoe means in contact with said slant plate.

2. A slant plate type hydraulic device as set forth in claim 1 wherein said spring means comprises a spring member and a retainer plate for holding said spring member in contact with said press plate.

3. A slant plate as set forth in claim 2 wherein said retainer plate is fixed to said holder means.

4. A slant plate type hydraulic device as set forth in claim 1 wherein said spring means comprises a resilient plate, said resilient plate having a first portion thereof contacting and pushing said press plate.

5. A slant plate type hydraulic device as set forth in claim 4 wherein said resilient plate has a second portion fixed to said holder means.

6. A slant plate type hydraulic device as set forth in any one of claims 1, 2, 3, 4, 5 wherein said holder means is rotatably mounted on said frame.

7. A slant plate type hydraulic device as set forth in any one of claims 1, 2, 3, 4, 5 wherein each said plunger means includes a spherical head portion and wherein said shoe means is mounted on said spherical head portion.

8. A slant plate type hydraulic device as set forth in claim 7 including a hydraulic fluid passage extending through said plunger means and said shoe means into a space formed between said shoe means and said slant plate means, wherein hydraulic fluid under pressure in said space reduces the contact pressure between said shoe means and said slant plate means.

* * * * *